US005996798A

United States Patent [19]

Gessert

[11] Patent Number: 5,996,798

[45] Date of Patent: Dec. 7, 1999

[54] AIR-PACK PACKAGING METHOD AND MEANS

[76] Inventor: Roy E. Gessert, 10150 Stern Ave., Cupertino, Calif. 95014

[21] Appl. No.: 08/951,960

[22] Filed: Oct. 17, 1997

[51] Int. Cl.[6] ..... B65D 81/02

[52] U.S. Cl. ..... 206/521; 156/145; 206/522

[58] Field of Search ..... 156/145, 147; 206/521–523, 584, 591, 592, 594

[56] References Cited

U.S. PATENT DOCUMENTS

| | | | |
|---|---|---|---|
| 3,181,693 | 5/1965 | Freistat | 206/523 |
| 4,093,068 | 6/1978 | Smrt | 206/522 |
| 4,905,835 | 3/1990 | Pivert et al. | 206/522 |
| 5,007,539 | 4/1991 | Ruter | 206/592 |
| 5,236,088 | 8/1993 | Dhority et al. | 206/523 |
| 5,316,149 | 5/1994 | Tate | 206/584 |
| 5,348,157 | 9/1994 | Pozzo | 206/522 |

*Primary Examiner*—Jim Foster
*Attorney, Agent, or Firm*—John J. Leavitt

[57] ABSTRACT

Presented is an "air-pack" support and cushioning unit for use in confronting pairs in cooperative association with a shipping container or carton to support an article within the container in spaced and cushioned relation to the walls of the container. In one aspect, the "air-pack" unit includes a base member to one surface of which is sealingly attached a flexible sheet of synthetic resinous material to form, with the base member, a capsule having resilient and compressible side walls defining a void within which is contained a fluid at approximately atmospheric pressure and/or a comminuted quantity of a resilient and compressible substance that retains the capsule extended to form a resiliently and compressible portion which conforms to the configuration of the interior surfaces of the container and exterior surface portions of an article to be supported and protected from damage from impact within the container. Also presented is a simple method for fabricating the "air-pack" unit.

30 Claims, 4 Drawing Sheets

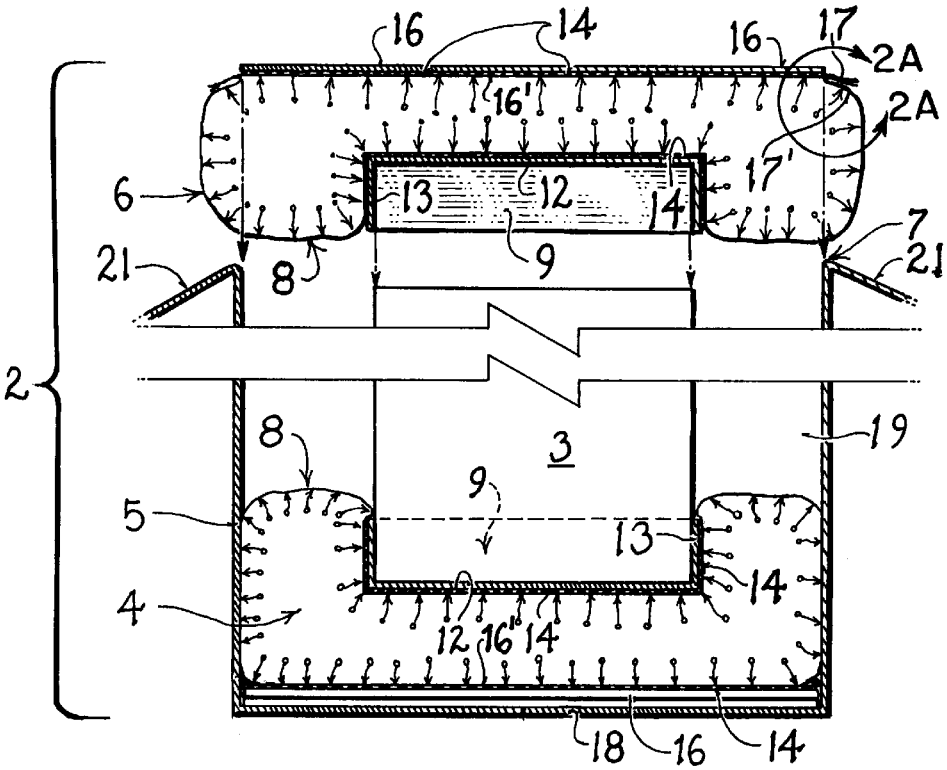
Fig_2
Fig_3 PRIOR ART
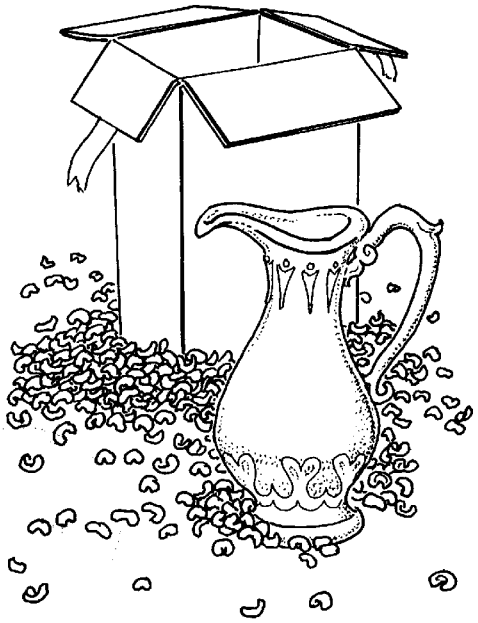
Fig_4 PRIOR ART
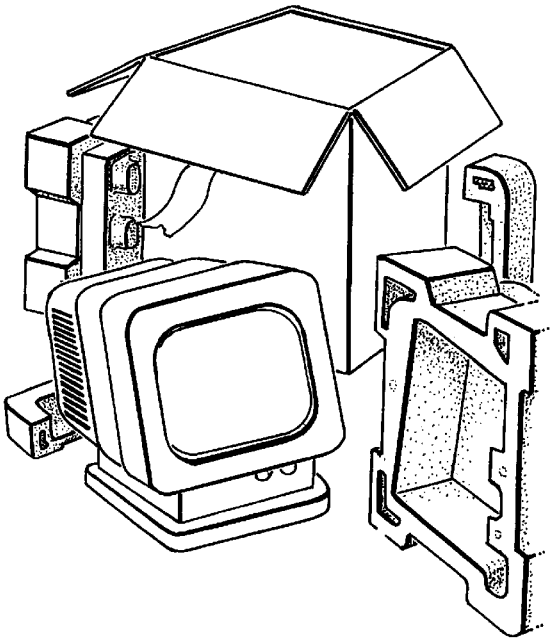

Fig_5
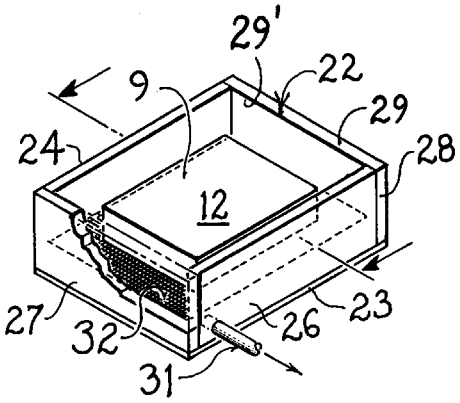
Fig_6
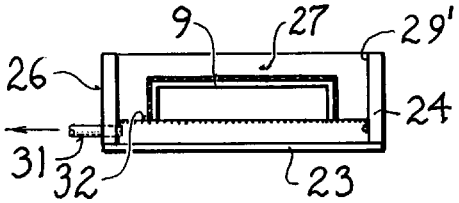
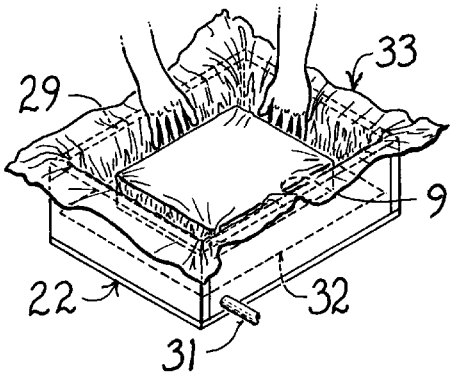
Fig_7
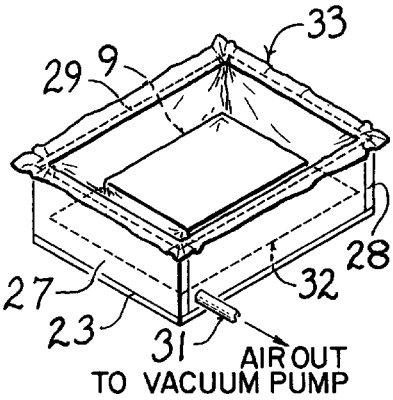
Fig_8
Fig_9
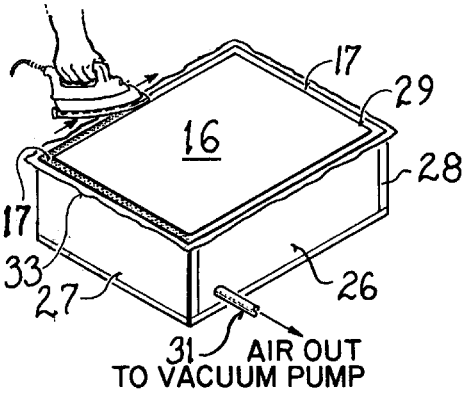
Fig_10
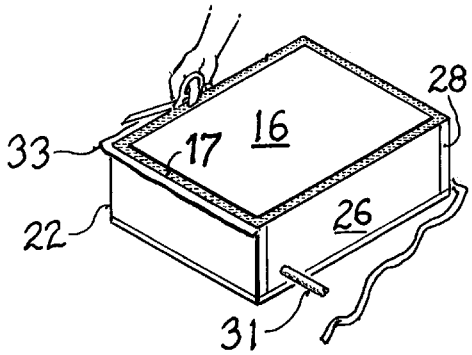

AIR-PACK PACKAGING METHOD AND MEANS

BACKGROUND OF THE INVENTION

1. Field of the Invention.

This invention relates to environmentally responsible packaging methods and means for supporting and isolating an article to be shipped within a carton or container in such a manner that the article is protected against damage from impact shock imposed on the carton or container, and more particularly to a packaging method and means which utilizes at least one pair of confronting resilient and compressible cushioning means that surround or partially surround the article to be shipped and which cushioning means are wholly or partially interposed between the article to be shipped and the container or carton in which it is shipped.

2. Description of the Prior Art.

A preliminary patentability and novelty search in connection with this invention has revealed the existence of the following U.S. Pat. Nos.

| | | |
|---|---|---|
| 2,275,575 | 4,495,237 | 4,619,055 |
| 4,869,939 | 5,030,501 | 5,518,802 |

As indicated by the patents listed above, there has been a concerted effort over an extended interval to provide some type of protective structure to resist the deleterious effect of impact forces on an object. Thus, in U.S. Pat. No. 2,275,575, there is disclosed an underliner for floor coverings that includes a multiplicity of interconnected semi-spherical pockets over which an air-impervious membrane is adhered so as to trap air within the interconnected pockets. Thus, a weight or impact imposed on any small portion of the floor covering effects compression of a limited number of the pockets and the air therein which, because of the compression forces imposed thereon, is transferred through appropriate channels into adjacent pockets.

In U.S. Pat. No. 4,495,237, a pyramidal core structure is formed by two opposing panels, each of which is formed with a plurality of truncated hollow pyramids embossed thereon. The two panels may be inverted and mated to form a core structure. It is contended by this patent that the pyramidal core structure supports loads and distributes stresses in such a manner as to closely approximate stress distribution in a solid panel.

U.S. Pat. No. 4,619,055 relates to a cushioning pad that is particularly useful for inclusion as an inner sole in shoes to protect the human foot and body while walking or standing. The cushioning pad is formed by multi-layers of materials each of which performs a specific function such as moisture absorption, resiliency such as foam rubber which molds to the individuals particular foot contour, and a shock absorbing layer of soft naturally resilient latex rubber. Air holes are provided in the pad thus formed to provide for the circulation of air therethrough.

U.S. Pat. No. 4,869,939 relates specifically to an interconnecting air incapsulating cellular material in sheet form that appears quite similar to the underliner for floor coverings disclosed in U.S. Pat. No. 2,275,575 in which adjacent air encapsulating cells are in flow communication so that upon direct pressure to one of such cells, the air may be displaced and can flow to an adjacent cell, thus dissipating the energy of an impact, weight or load shock.

The cushioning structure disclosed by U.S. Pat. No. 5,030,501 is quite similar to the pyramidal core structure disclosed in U.S. Pat. No. 4,495,237 in that a plurality of specifically shaped cells containing a fluid, such as air, are formed between two or more planar sheets of pliable material bonded to the shaped relatively rigid cell structures. The cell structures are disclosed as being in fluid communication with each other to provide a valved fluid transfer from one cell to the next.

Lastly, U.S. Pat. No. 5,518,802 also discloses a cushioning structure for dampening the shock of impacts on the cushioning structure. The cushioning structure includes a matrix of specifically shaped cells containing a fluid, such as air or other gas, which is trapped within the cells by flexible planar sheets bonded thereover. Fluid communication is provided between the adjacent specifically shaped cells None of the patents listed above appear to disclose a cushioning system that constitutes a prefabricated "air-pack" that is designed and configured to specifically fit about a product to be shipped, and to fit within the confines of the shipping container in which the article that is cushioned by the "air-pack" is to be shipped. Accordingly, one of the important objects of the present invention is to provide, as an article of manufacture, such a specifically prefabricated cushioning system or "air-pack" that gives consideration to the exterior dimensions and configuration of the article to be shipped, and the interior dimensions of the container in which the article is to be shipped, and which is resiliently and compressibly interposed in the space between the article to be shipped and the inner surfaces of the container so as to provide a resiliently compressible air "pillow" between the article and the container to absorb the shock of impacts.

At the present time, there are several methods and structures for cushioning articles to be shipped that both create waste and are wasteful of our natural resources. One such method is the formation and use of so called "popcorn" particles of Styrofoam that surround an article to be shipped in a corrugated cardboard carton, for instance, and whose function is to absorb impact shocks that might otherwise damage the article being shipped. Another structure that is frequently used is a preformed Styrofoam block or blocks or elongated stringers that to some extent conform to the configuration of the associated article being shipped and are interposed between the interior surface of the container and the article so that, in effect, the article being shipped is retained and cushioned by the Styrofoam blocks in a spaced relationship with the interior surface of the container in which it is shipped. These Styrofoam blocks however are not resilient or elastic and once crushed they do not regain their original shape. Additionally, Styrofoam is practically indestructable in landfill operations Other impact absorbing materials and technologies include polyurethane or polyethylene expanded foam, prefabricated foam corner blocks, spherical polyethylene corner block assemblies, thin sheet foam wraps and "bubble pack" wraps wherein many small pockets of entrapped air provide impact absorbing characterstics. The aforementioned materials and technologies are comparatively heavy (2 pounds per cubic foot of material), must be cut and shaped from large sixty-four cubic foot "buns" or stored in voluminous rolls, all of which cost and wastefully consume our natural resources time and time again during their entire life cycle: raw stock manufacture, transport, storage, configuration, transport to consuming industries, storage, transportation of the protected product, disposal of the packaging material by the product end user, recycling of the disposed product or landfill operation.

Comparatively speaking, one pound of air-pack material constitutes one hundred cubic feet of packaging and cushioning in a preassembled space of one cubic foot, verses a weight of two hundred or more pounds (per hundred cubic feet) for "celled" foams. The air pack invention results therefore in about a four-hundred times reduction in transportation costs and two-hundred times reduction in storage space over existing packaging and cushion technologies.

Accordingly, it is yet another object of the present invention to provide an "air-pack" system or unit for which the raw materials are inexpensive to manufacture, which occupy a minimal amount of space relative to its fabricated form, is effective to resiliently cushion an article to be shipped within a shipping container, and which minimizes the waste of packaging because it uses air or previously generated materials to cushion an article, protecting it from damage which may be incurred during shipping and handling. Additionally, the "air-pack" unit forming the subject matter of this invention is formed from. biodegradable materials that readily decompose, without creating toxic materials, when buried in landfills.

The prior art is replete with patents that disclose the concept of utilizing a selectively inflatable bladder which may surround or be interposed in deflated condition between an article to be shipped and the interior of a container and then selectively inflated to trap air within the bladder and thus provide a cushion for the article contained within the shipping container. Such selectively inflatable bladders pose problems such as perforations and non-conformance with the shape of the article being shipped that are not encountered by the unitary "air-pack" system forming the subject matter of this invention which incorporates ambient atmospheric pressure air at the time of manufacture as a result of the method of manufacture. By contrast, with selectively inflatable bladders, too much air (or other gas) may be injected into the bladder causing it to rupture, to thus lessen or eliminate its shock absorbing or dampening purpose, or to impose an inordinate amount of pressure on the article and container, thus subjecting the article to be cushioned to damage during handling or transportation. Or, insufficient air or other gas may be injected into the bladder, thus diminishing the cushioning effect of the bladder. Another problem is that the valves that are utilized in such bladders may leak, releasing the air or other gas contained therein, thus defeating the purpose of the bladder. Additionally, costly air or gas compressing equipment must be purchased and maintained. Accordingly, a still further object of the present invention is the provision of an "air-pack" unit as an article of manufacture which incorporates fluid, such as air or gas, at approximately sea level atmospheric pressure at the time of manufacture.

A still further object of the invention is the provision of a fluid-containing cushioning unit having a configuration that generally conforms to the configuration of the container in which it is mounted, and one side or surface of which is adhesively secured to a base member of conforming configuration and dimension to slip snugly into the container in which the article to be shipped is to be packed.

Still another object of the invention is the provision of a shipping container system that includes an exterior container, a first fluid filled "air-pack" cushioning member disposed within the container and supported on the bottom thereof in such manner as to support an article to be shipped, the cushioning member having a preformed recess that circumscribes a "bottom" portion of the article to be shipped, and a second fluid filled "air-pack" cushioning member incorporating a preformed recess that may be superimposed around the upper end portion of the article within the shipping container, with peripheral portions of the two "air-pack" cushioning members circumscribing the article and resiliently spanning the space between the article and selected interior surface portions of the shipping container to thus form a nacelle, within which the article to be shipped is cushioned by a pair of confronting "air-pack" cushioning members or units.

Yet another object of the invention is the provision of simple and inexpensive apparatus for forming the "air-pack" unit that forms the cushioning member by which articles shipped in shipping containers are supported and cushioned to protect them from damaging impact shocks.

Still another object of the invention is the provision of a shipping container system that includes an exterior container, a first cushioning member disposed within the container and. cradling an article to be shipped, the cushioning member having a preformed recess that circumscribes a portion of the article to be shipped, and a second cushioning member within the container and confronting the first cushioning member and incorporating a preformed recess that cradles another portion of the article within the shipping container, with peripheral portions of the two cushioning members circumscribing the article and resiliently spanning the space between the article and selected interior surface portions of the shipping container to thus form a nacelle within which the article to be shipped is cushioned by the pair of confronting cushioning members.

The invention possesses other objects and features of advantage, some of which, with the foregoing, will be apparent from the following description and the drawings. It is to be understood however that the invention is not limited to the embodiments illustrated and described since it may be embodied in various forms within the scope of the appended claims

SUMMARY OF THE INVENTION

In terms of broad inclusion, the "air-pack" unit forming the subject matter of this invention comprises an air filled cushioning member formed from sheet plastic and having a base member, such as a quadrilateral sheet of relatively inflexible corrugated cardboard that resists the passage of air therethrough, adhesively adhered air-tight to the peripheral edges of the sheet plastic to form a cushioning "pillow" or "balloon" or "capsule", the base member having the configuration and dimensions to fit snugly into a specific shipping container for which the "air-pack" unit is designed to fit. On the opposite side of the "capsule" remote from the base member, there is adhered to the surface of the sheet plastic that forms the capsule a quadrilateral insert in the form of a shallow box or recess the open end of which generally conforms to the configuration of the associated article to be cushioned.

Thus, one "air-pack" unit may be inserted into the shipping container so that the base member of the "air-pack" unit is contiguous with a closed end of the shipping container. The article to be shipped is then deposited onto the "air-pack" unit so that it lies nestled within the quadrilateral box-like insert adhesively secured to the associated upper surface of the capsule. Then, a second "air-pack" unit in inverted relationship is deposited over the article to be shipped so that its upper end portion is closely enclosed by the quadrilateral box-like insert adhesively secured to the underside of the inverted capsule, while the base member that is adhered to the peripheral edges of the plastic sheeting and forms one side of the capsule fits snugly into the upper open end of the shipping container.

The "air-pack" units are thus conformed and squeezed resiliently between inner surface portions of the shipping container and outer surface portions of the article to be shipped, thus providing a resilient and shock absorbing nacelle within which the article to be shipped is resiliently cushioned. The upper "air-pack" unit is pressed inwardly until its base member is flush with the open end of the shipping container, at which time the closure flaps of the shipping container are folded over to overlap the base member, forming the final interior surface of the shipping container opposing the base member, whereupon the flaps may be secured in any customary manner such as with adhesive and/or strapping tape.

To manufacture each "air-pack" capsule, a shallow box-like assembly frame having an open upper end is provided with a screen spaced above the bottom of the assembly frame. A vent tube is provided communicating with the interior of the assembly frame below the screen so that air may be sucked from the interior of the assembly frame. A box-like insert having adhesive on its exterior surfaces is then inverted and placed centrally within the assembly frame with its open end resting on the screen. A sheet of air-tight flexible plastic is then superimposed over the assembly frame and the adhesive-coated exterior surface of the box-like insert, the plastic sheeting being tucked into the space between the insert and the inner surfaces of the assembly frame so that the insert lies recessed within the confines of the plastic sheeting and adhesively secured thereto.

Connection of the vent tube to a vacuum pump sucks air from the interior of the assembly frame under the plastic, causing it to adhere closely to the adhesive-coated exterior surfaces of the insert and to be pressed against the interior surfaces of the assembly frame but not adhesively secured thereto. The peripheral edge portions of the sheet plastic overlap the upper edges of the box-like assembly frame. A base member, conveniently a quadrilateral sheet of air-tight cardboard laminated to a sheet of plastic is then superimposed over the sheet plastic tightly adhered to the assembly frame walls and insert and draping over the upper edges of the frame so that the peripheral edges of the plastic sheet laminate that project beyond the peripheral edges of the cardboard portion of the base member impinge on the sheet plastic overlapping the top edges of the assembly frame. The base member may be secured air tight to the marginal edge portions of the underlying sheet plastic by adhesive applied to a peripheral edge portion of the plastic laminate on the underside of the cardboard portion of the base member, or it may be thermo-sealed by the application of heat to the contiguous overlapping union of the plastic laminate portion of the base member and the contiguous peripheral edge portions of the plastic sheeting draped over the edges of the assembly frame. It will of course be understood that when the base member is sealingly adhered to the peripheral edge portions of the plastic sheeting, the air naturally within the confines of the assembly frame box above the plastic sheeting is at atmospheric pressure and is trapped therewithin, thus forming a sealed air-filled. capsule or "pillow" having an air-tight base member on one side and a box-like recess on its opposite side. Following sealing of the base member to the peripheral edge of the plastic sheeting, the excess plastic sheeting material is trimmed so that the edge of the plastic sheeting generally coincides with the sealed edge of the plastic laminate portion of the base member and the fabrication of the "air-pack" unit is complete, and may be removed from the assembly frame after removal of the vacuum holding the insert-faced plastic sheeting within the confines of the assembly fixture.

BRIEF DESCRIPTION OF THE DRAWINGS

FIG. 2 is a vertical cross-sectional view taken in the plane indicated by the line 2—2 in FIG. 1. Portions of the structure are broken away to reduce the size of the view.

FIG. 3 illustrates conventional prior art material that is frequently used to pack an article for shipment, such as an expensive vase that is surrounded by "popcorn" Styrofoam particles when packed within the shipping container.

FIG. 4 illustrates another conventional method of packing articles in a manner to minimize damage, this packing material comprising Styrofoam blocks configured especially to fit the exterior configurations of the article to be shipped so as to fill the space between the article and inner surfaces of the shipping container.

FIG. 5 is a perspective view illustrating the assembly frame utilized to fabricate the "air-pack" unit forming one aspect of the subject matter of this invention.

FIG. 6 is a vertical cross-sectional view taken in the direction of the arrows in the plane indicated by the line 6—6 in FIG. 5.

FIG. 7 is a perspective view illustrating the manner in which the sheet plastic is draped within the assembly frame and over the adhesive-faced box-like insert.

FIG. 8 is a perspective view illustrating the manner in which the sheet plastic is sucked against the adhesive-faced insert and the interior side surfaces of the assembly frame when the vent tube is connected to a vacuum pump operated to suck air out of the assembly frame.

FIG. 9 is a perspective view illustrating the manner of thermo-sealing air-tight the plastic laminate portion of the base member to the upper contiguous peripheral edges of the sheet plastic so as to contain air at approximately atmospheric pressure within the "air-pack" unit.

FIG. 10 is a perspective view showing the manner in which the excess plastic sheeting material is trimmed from the "air-pack" unit following the thermo-sealing operation.

DESCRIPTION OF THE PREFERRED EMBODIMENT

Figure 1:
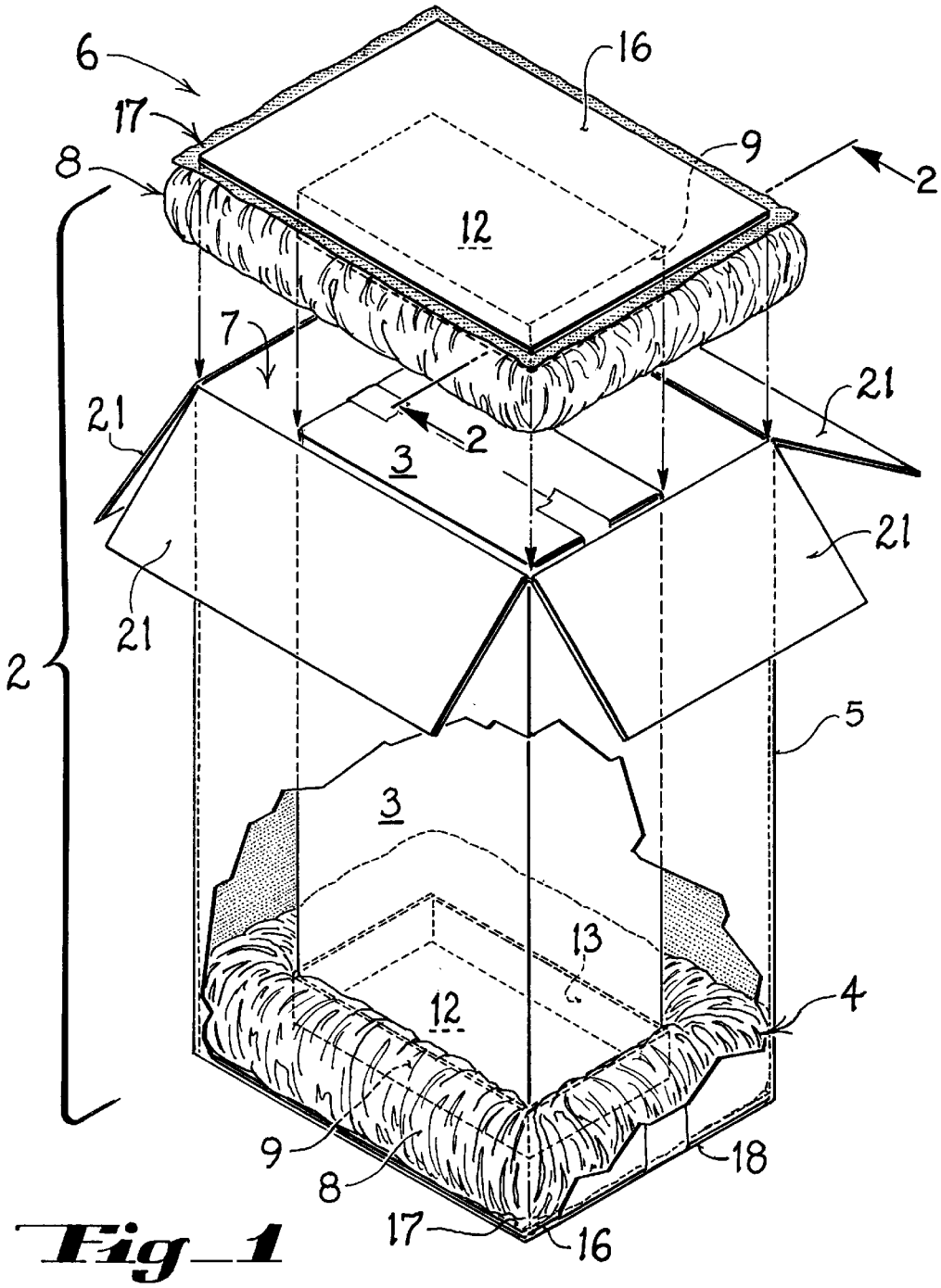
FIG. 1 is a perspective view illustrating a shipping container incorporating an "air-pack" unit in its bottom end and supporting an article to be shipped, and a second "air-pack" unit in position to be lowered into the open end of the shipping container and about the article to be shipped so as to resiliently support the article to be shipped between two air-filled "air-pack" units. A portion of the container is broken away to reveal its interior and the lower "air-pack unit.
Figure 2A:
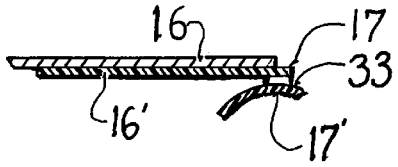
FIG. 2A is an enlarged fragmentary view of the structure enclosed by the line 2A in FIG. 2.

Referring first to FIGS. 1 and 2, in FIG. 1 is illustrated a partially complete assembly designated generally by the numeral 2, and incorporating an article to be shipped designated generally by the numeral 3, a first "air-pack" unit designated generally by the numeral 4 and positioned at the bottom of the container designated by the numeral 5, and a second "air-pack" unit designated generally by the numeral 6, all illustrated in perspective, with a portion of the container broken away to reveal the internal assembly. The article to be shipped is shown supported on and cushioned by the first "air-pack" unit, while the as yet unsupported upper end portion of the article to be shipped is positioned generally adjacent the upper open end 7 of the shipping container. In this view, for purposes of clarity and explanation, the second "air-pack" unit 6 is illustrated in position above the open end of the container, ready to be lowered into the container to provide an air-filled "air-pack" cushioning unit in the space above and surrounding the upper end portion of the article to be shipped. The upper surface of the "air-pack" unit will ultimately reside substantially flush with the upper open end of the shipping container.

For a more precise understanding of the construction of each of the "air-pack" cushioning units, which in this instance are essentially identical but shown in confronting positions in FIG. 1, reference is now made to FIG. 2, which illustrates a vertical cross-sectional view through the partial assembly of FIG. 1. As shown in FIG. 2, first and second "air-pack" cushioning units 4 and 6, respectively, are identical to one another but in a mutually confronting relationship in much the same way as illustrated in FIG. 1. Accordingly, since the "air-pack" cushioning units 4 and 6 as illustrated are essentially identical though may be conforming to the specific shape of the product to be shipped, only one will be described in detail with the same reference numbers being applied to corresponding elements of the second "air-pack" cushioning unit.

Thus, referring to FIG. 2, the "air-pack" cushioning unit 4 is shown disposed in the bottom of the container 5, which may conveniently be formed from corrugated cardboard or other suitable material. It will be seen that "air-pack" cushioning and support unit 4 comprises a balloon-like capsule 8, preferably formed from an appropriate synthetic resinous material in sheet form, hereinafter referred to as sheet plastic. The sheet plastic that ultimately forms the air-filled capsule 8 is initially draped and formed about the outer peripheral surfaces of an insert designated generally by the numeral 9 that includes a bottom wall 12 and side walls 13 to form a unitary shallow box-like insert, formed conveniently from corrugated cardboard or other suitable material. The insert is adhesively secured to the impinging surfaces of the sheet plastic material and adhered thereto by a layer 14 of adhesive applied on the bottom and sides of the insert.

To form the opposite surface of the capsule 8 opposing the insert 9, and to control the configuration of the capsule so that it fits snugly into the open end of the outer container, there is provided a relatively rigid base member 16, having a plastic sheet 16' laminated thereto with peripheral edge portions 17 extending beyond the associated edges of the base member. The base member is preferably configured and dimensioned so that the perimeter of the base member 16 fits snugly into the interior of the container 5 as illustrated, which may or may not be quadrilateral. As with the box-like insert 9, the base member 16, is adhered sealingly to the peripheral edge portions of the plastic sheeting by a layer 171 of adhesive as will be explained in greater detail hereinafter.

Thus, as shown in FIG. 2, the capsule 8 may be filled with air that resists external compressive forces by pressing outwardly as indicated by the multiplicity of arrows pointing outwardly in the view, to form a resilient and compressible capsule on the surface of which the box-like insert 9 is nestled, opening upward as seen in the lower portion of this figure and opening downwardly as seen in the upper portion of the figure. In place of only air, the capsule 8 may also contain specific quantities of a liquid or granulated solid, such as sand, or lighter granulated or comminuted material such as ground up molded Styrofoam or chaff derived from various agricultural processes, such as almond and walnut hulls and shells, rice hulls, and a myriad of other materials that might otherwise be disposed of by burning or in landfill operations. It will of course be understood that when these types of granulated shock-absorbing materials are used, the sheeting from which the capsule is formed may or may not be air-tight, but should have sufficient strength to contain the cushioning material when impacted. Additionally, it should be understood that such materials may be utilized in conjunction with a quantity of air contained within the capsule.

Thus, as seen in FIG. 2, the lower end portion of the article 3 is nestled within the confines of the box-like insert 9 adhesively fixed to the associated surface of the capsule 8. As will be seen and understood, the weight of the article 3 compresses the capsule 8 so that the base member 16 normally lies in contiguous abutting relationship with the lower end wall 18 of the container 5, but here shown for greater clarity and understandability of the structure as being slightly removed from the end wall 18 of the container. It should be understood that while the weight of the article may compress the capsule portion below the article, there always remains a space defined by the capsule between the lower end of the article and the associated end of the container. As seen in FIG. 2, the peripheral portions of the capsule 8 that surround the box-like insert 9 project upwardly into the space 19 between the outer surfaces of the article and the inner surfaces of the container 5, thus providing a cushion therebetween. In like manner, the capsule below the box-like compartment 9 provides a resilient. compressible cushion between the bottom 12 of the insert and the base member 16 forming the opposing side of the capsule. Thus, there is provided by each of the capsules 8, a flexible and compressible "air-pack" unit that resiliently surrounds the lower end portion of the article to be shipped, and which fills the space between the lower portion of the article to be shipped and the surrounding confining walls of the container 5 with supporting and cushioning material.

It will thus be seen that when the second "air-pack" unit 6, which is now inverted in relation to and confronting the lower "air-pack" unit 4, is inserted into the open end of the container and superimposed over the article 3, the upper end portion of the article 3 will project into the recess formed by the box-like insert 9 adhered to the undersurface of the capsule 8. Continued downward pressure applied to the "air-pack" unit 6 causes the peripheral portions of the capsule that surround the box-like insert 9 to squeeze resiliently into the upper open end 7 of the container 5 until ultimately the base member 16 of the second "air-pack" cushioning unit 6 lies substantially flush with the open end of the container 5. When this relationship has been achieved, it will be seen that the article 3 is substantially supported and cushioned at its opposite end portions within two opposing shock absorbing capsules that provide generally toroidal peripheral portions that prevent impact shocks that might be imposed against the outer side surfaces of the container 5 from being transmitted to the article being shipped. In like manner, the portions of the capsules that lie between the base members and the associated inserts also prevent impact shocks that might be imposed on the ends of the container from being transmitted to the article.

It will of course be understood that the box-lie inserts 9 illustrated in FIGS. 1 and 2, are here illustrated as being generally quadrilateral to fit a generally quadrilateral article to be shipped. In actual practice, these nacelle-forming inserts 9 may be configured in any shape necessary to accommodate the associated end portion of whatever configuration is presented by the article to be shipped. While they are here illustrated as being identical, it should be understood that in some instances the article to be shipped may have a different configuration at one end from its configuration at the opposite end. In that instance, each of the associated "air-pack" units 4 and 6, respectively, will be provided with an insert 9 that conforms to the configuration of the article being shipped. Once the article being shipped is resiliently supported and cushioned between the two opposing "air-pack" units, with the upper "air-pack" unit and its base 16 lying substantially in the same plane as the open upper end of the container 5, the upper flaps 21 of the container are folded over onto the base member 16 and sealed in the usual manner which may include adhesive and/or strapping tape disposed about the container to hold the closure flaps 21 in planar alignment.

A better understanding of the structure, mode of operation and function of each of the "air-pack" units 4 and 6 will be achieved by reference to FIGS. 5 through 10, wherein the method of manufacturing each of the "air-pack" cushioning units is illustrated. Thus, it will be seen that the manufacturing apparatus includes an assembly frame designated generally by the numeral 22 and comprising a box-like structure having a bottom wall 23, side walls 24 and 26, and end walls. 27 and 28. The box-like assembly frame 22 thus forms an enclosure defined by the inner wall surfaces and the top edges 29 (collectively) of the end and side walls, the top edges 29 forming an upper rim that defines the height of the enclosure formed by the assembly frame.

Conveniently, the assembly frame may be fabricated from appropriate lumber, farmed from selected soft or hardwoods, or it may be fabricated from some other suitable material such as plastic or metal. Extending through one wall of the assembly frame is a vent tube 31 that communicates at one end with the interior thereof and which, exteriorly, may be connected by its opposite end to an appropriate vacuum pump (not shown). The purpose of the vent tube 31 will be described hereinafter. Mounted within the assembly frame is a screen 32 that is elevated above and preferably parallel to the bottom wall 23 of the assembly frame, and above the vent tube 31 as illustrated in FIG. 6. Supported on the screen 32, generally centered between the side and end walls of the assembly frame, is the box-like insert 9 the closed end 12 of which lies parallel to and spaced above the screen 32 so that the edges of the side walls 13 impinge and are supported by the screen 32, the open end of the box-like insert thus facing or confronting the screen.

As illustrated in FIG. 2, the insert 9 is spaced from the end and side walls of the assembly frame. Conveniently, the insert 9 is preformed from an appropriate corrugated cardboard or other type of biodegradable material that facilitates recycling or re-use of the "air-pack" units to be formed. It should be understood that the insert 9 is not a permanent part of the assembly frame, since it is subsequently adhered to the associated surface of the sheet plastic material designated generally by the numeral 33 and illustrated in FIG. 7. As there shown, the sheet plastic 33 may be conveniently formed from any of the several different synthetic resinous materials that are pliable, thin and tough, compatible with several different types of adhesives, and which are also biodegradable so as to enable disposability or recycling of the sheet plastic material when the "air-pack" unit is no longer serviceable.

As shown in FIG. 7, the sheet plastic 33 is draped over the assembly frame 22 and is tucked into the toroidal space that surrounds the insert 9, being draped over the bottom wall 12 of the insert as shown, and being pressed against the inner surfaces of the end and side walls of the assembly frame. Preferably, the sheet plastic is of sufficient size to overlap the top edges 29 of the assembly frame as illustrated. Prior to placement of the sheet plastic as illustrated in FIG. 7, the exterior surfaces of the bottom wall 12 and the side walls 13 of the insert 9 are coated with an appropriate adhesive 14 (FIG. 2) so that when the sheet plastic is draped into the interior of the assembly frame as shown in FIG. 7, the central portion of the sheet plastic will adhere adhesively and permanently to the underside or bottom 12 of the insert 9, with associated portions of the sheet plastic adhering to the side walls 13 of the insert. It is important to note that the screen and the inside surfaces of the assembly frame are not coated with adhesive, and that the screen admits the passage of air therethrough.

Referring to FIG. 8, when the sheet plastic is thus draped over and into the assembly frame, the base member 16, with its peripheral plastic laminate edge portion 17 coated with adhesive 17', lies superimposed over the assembly frame with the adhesive coated plastic edge portions 17 lying superimposed over the sheet plastic overlapping the edge portions 29 of the assembly frame When the base member is lowered onto the assembly frame, the base member 16 is caused to adhere sealingly to the peripheral portion of the sheet plastic 33 that overlaps the top edges 29 of the assembly frame. Placement of the base member 16 in such fashion seals the capsule 8 that is thus formed and traps within the interior of the capsule 8 air under preferably sea level atmospheric pressure and any other cushioning material that may be selectively included within the capsule as heretofore disclosed.

To insure that a maximum amount of volume is provided in the capsule 8, the vent tube 31 is connected to a vacuum pump and air is pulled through the screen from the interior of the assembly frame so as to cause the sheet plastic 33 to be contiguous with the interior surfaces of the assembly frame and the screen. Such evacuation of the air from underneath the sheet plastic within the assembly frame enclosure to cause close adherence of the sheet plastic to the interior surfaces of the assembly frame and the screen is preferably done prior to adherence of the base member 16 over the peripheral portions of the sheet plastic, thus enabling the sheet plastic to conform to the interior configuration of the assembly frame above the screen This configuration is illustrated in FIG. 8 of the drawings.

Referring to FIG. 9, it will be seen that in this view, the base member 16, with its peripheral plastic laminate edge portion 17 devoid of adhesive, has been superimposed over the peripheral edge of the sheet plastic, the configuration of the base member 16 preferably corresponding to the configuration of the inner top corner edge 29' of the assembly frame 22. Heat is then applied to the overlapping edges of the sheet plastic 33 and plastic laminate portions 17 overlying top edge 29 of the assembly frame in the manner illustrated in FIG. 9 so as to form a thermally sealed zone between the peripheral edge portion of the plastic laminate 16' and the peripheral edge portion of the sheet plastic 33 that overlaps the edge 29 of the assembly frame. This insures that whatever atmospheric pressure air is trapped within the capsule thus formed is retained therein. As illustrated, a hot iron may be used to effect thermal sealing of the base member 16 to the contiguously associated peripheral edge of the sheet plastic material so as to insure air-tight thermal sealing of these two elements. In production, it is contemplated that a single heated jig (not shown) may be operatively pressed simultaneously on the overlapping plastic members to effect thermal sealing of the base member to the sheet plastic.

Figure 11:
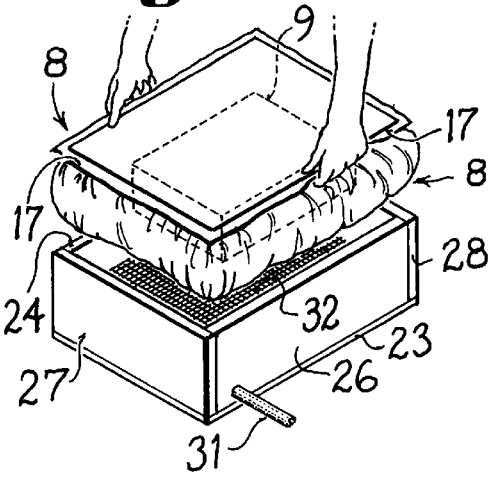
FIG. 11 is a perspective view illustrating the manner in which the completed "air-pack" unit is withdrawn from the assembly frame.
Figure 12:
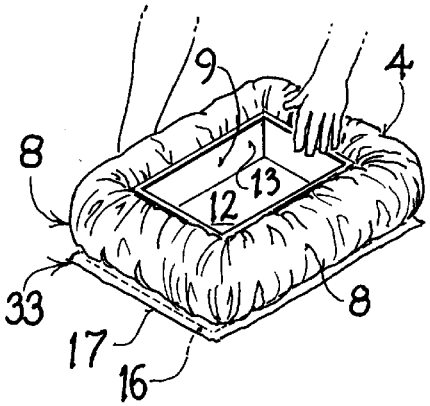
FIG. 12 is a perspective view of the "air-pack" unit of FIG. 11 inverted so that the box-like insert that cradles the article to be shipped is exposed to view.

Following thermal sealing of the base member 16 to the peripheral edge of the sheet plastic as illustrated, the excess plastic is trimmed from around the base member as illustrated in FIG. 10. The waste material that is trimmed away may be disposed of by recycling. Following the trimming operation, and referring now to FIG. 11, it will be seen that the now completed "air-pack" cushioning unit may be easily lifted out of the assembly frame after disconnecting the vent tube 31 from the vacuum pump. If necessary, the interior of the assembly frame may be back-filled with air through the vent tube to facilitate removal of the completed "air-pack" unit from the assembly frame. Following removal, the completed "air-pack" unit may be set aside as illustrated in FIG. 12, and multiple "air-pack" units may be stacked one above the other in inventory until needed for use in packing articles to be shipped in the manner heretofore described.

Figure 13:
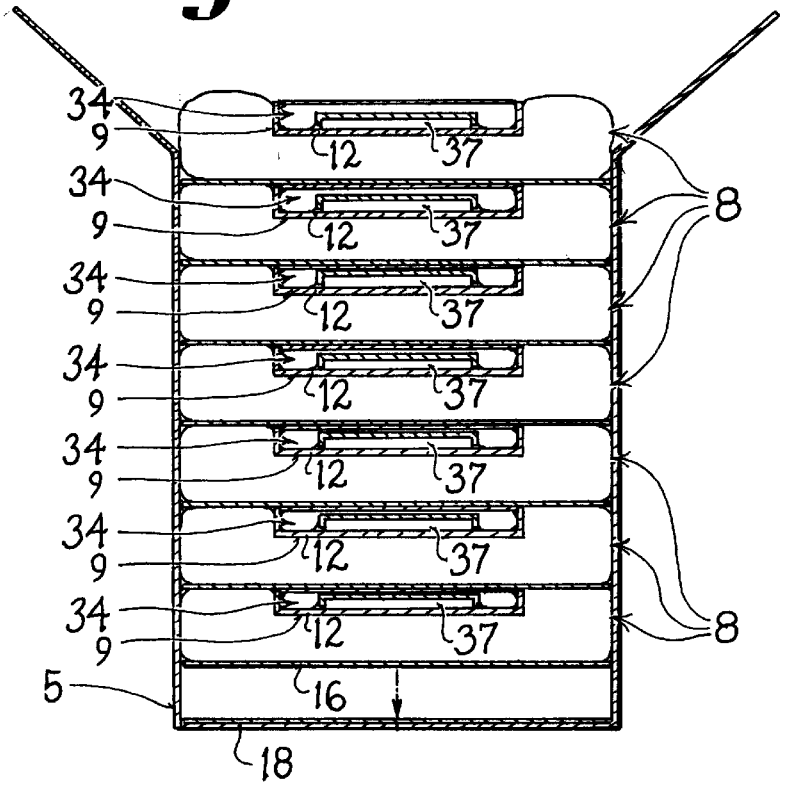
FIG. 13 is a vertical cross-sectional view through a shipping container accommodating fourteen "air-pack" units superimposed one above the other in confronting pairs for supporting and cushioning articles to be shipped.

Because each of the "air-pack" units is exceedingly light in weight yet resiliently conformable to a square or rectangular or other configured container 5, as illustrated in FIG. 13, it will be apparent that multiple numbers of these "air-pack" units may be stacked one upon the other within the container 5, each pair of the "air-pack" units supporting a separate article to be shipped, with the article being shipped on each "air-pack" unit being contained within the recess formed by the insert 9. It will be seen that each article to be shipped, a printed circuit board, for instance, in each "air-pack" unit 4 lies nestled on the bottom member 12 of the insert 9. To retain the article to be shipped against movement in any direction, there is provided superimposed over the article to be shipped a smaller "air-pack" unit designated generally by the numeral 34 and itself provided with a base member 35 similar to the base member 16, and a subsidiary insert 36 which in this view is shown to be opened downward so that the open end of the box-like insert 36 abuts the inner bottom surface of the insert 9. There is thus formed a recess 37 within which the article to be shipped, whether it be a printed circuit board or same other similarly configured article of manufacture, may be enclosed and shipped while being protected on all sides by a resilient cushion of air or other cushioning material by virtue of the pair of "air-pack" units within which it is enveloped.

When the shipping container 5 has been completely filled with as many "air-pack" units as is desirable, then the flaps 21 of the container are pivoted into closed condition so that they impinge on the upper surface of the top most "air-pack" unit, thus functioning to retain the entire stack in a highly stable yet protected condition and relationship with the surrounding container 5 within which the plurality of "air-pack" units are enclosed.

Having thus described the invention, what is believed to be new and novel and sought to be protected by letters patent of the United States is as follows.

I claim:

1. A packaging system wherein an article to be shipped is supported by resiliently compressible cushioning means, comprising:

a) an exertior container having opposed side and end walls defining the interior surface limits of said container within which said article to be shipped is disposed in spaced relation to said interior surfaces;

b) a first sealed and non-inflatable cushioning unit distended by encapsulated fluid at approximately atmospheric pressure and including a resiliently compressible portion disposed within the container and spanning the space between the opposed interior surfaces of said exterior container and circumscribing selected exterior surfaces of said article to be shipped; and c) a second sealed and non-inflatable cushioning unit distended by encapsulated fluid at approximately atmospheric pressure and confronting said first sealed and non-inflatable cusioning unit and including a resiliently compressible portion disposed within the container and spanning the space between the opposed interior surfaces of said exterior container and circumscribing selected exterior surfaces of said article to be shipped;

d) whereby said article is resiliently retained supported within said container and is spaced and resiliently cushioned from said opposed side and end walls by said confronting first and second sealed and non-inflatable distended cushioning units.

2. The packaging system according to claim 1, wherein the resiliently compressible confronting portion of each of said first and second sealed and non-inflatable cushioning units comprises a distended capsule containing a selected fluid at approximately atmospheric pressure whereby said capsule resiliently spans the space between said article to be shipped and the associated side and end walls of said container.

3. The packaging system according to claim 2, wherein each said capsule is provided with a circumscribing recess on the side thereof confronting the other capsule for receiving nestled therebetween within said confronting and circumscribing recesses an associated portion of said article to be shipped.

4. The packaging system according to claim 3, wherein each said capsule is provided with a relatively inflexible base member sealingly attached to the side of said sealed and non-inflatable cushioning unit opposed to said recess and contiguous to the associated end wall of said container, said relatively inflexible base member having peripheral edge portions defined by peripheral edges lying juxtaposed to the interior surfaces of said container.

5. The packaging system according to claim 2, wherein each said capsule is formed partially of flexible synthetic resinous material and partially of relatively inflexible material.

6. The packaging system according to claim 4, wherein each said capsule is formed from a sheet of flexible synthetic resinous material having peripheral edge portions sealingly secured to said peripheral edge portions of said relatively inflexible base member.

7. The packaging system according to claim 2, wherein at least one of said confronting capsules contains a comminuted resilient and compressible substance in addition to said fluid at approximately atmospheric pressure.

8. The method of assembly of an "air-pack" unit for use in confronting pairs within a shipping container to resiliently support and cushion against damage from impact shocks an article to be shipped disposed between said confronting pair of "air-pack" units within said shipping container, consisting of the steps of:

a) providing an assembly frame defining a recess having a closed bottom, side walls and an open upper end opposite said closed bottom;

b) supporting a foraminous screen within said assembly frame spaced from said closed bottom;

c) supporting on said foraminous screen an insert defining a recess having a closed bottom facing the open end of said assembly frame, side walls and an open end confronting said foraminous screen and facing the closed bottom of said assembly frame;

d) draping over said assembly frame and said insert supported on said foraminous screen a flexible sheet of synthetic resinous material having a central portion surrounded by peripheral edge portions and attaching the central portion of said sheet onto and around said insert so it adheres permanently to the bottom and side walls of said insert and lies contignously but loosely on the screen supporting said insert and abuts contiguously but loosely the associated inner surfaces of the side walls of said assembly frame, and lapping said peripheral edge portions of the sheet of synthetic resinous material over the upper edges of said side walls that define said open upper end of the assembly frame; and e) sealingly adhering a base member to the peripheral edge portions of said sheet of synthetic resinous material that lap over the upper edges of the side walls of the assembly frame whereby a capsule is formed having a hollow interior containing a fluid at approximately atmospheric pressure.

9. The method according to claim 8, wherein said insert and said base member are formed from biodegradable materials.

10. The method according to claim 8, wherein said base member forms an air-tight side of said capsule, and said insert is attached to the opposite side of the capsule.

11. The method according to claim 8, wherein a quantity of comminuted resilient and compressible substance is deposited within the assembly frame prior to attaching said base member to said flexible sheet of synthetic resinous material, whereby when said base member is thereafter sealingly attached to said peripheral edge portions of the flexible sheet of synthetic resinous material there remains sealed within said capsule fluid at approximately atmospheric pressure and said comminuted resilient and compressible substance.

12. The method according to claim 8, wherein air is withdrawn from the interior of said assembly frame below said foraminous screen following draping of said flexible sheet of synthetic resinous material over said assembly frame.

13. A packaging system wherein an article to be shipped is supported by resiliently compressible cushioning means, comprising:

a) an exterior container having opposed side and end walls defining the interior surface limits of said container within which said article to be shipped is disposed in spaced relation to said interior surfaces;

b) a first cushioning unit including a resiliently compressible portion disposed within the container and spanning the space between selected opposed interior surfaces of said exterior container and selected exterior surfaces of said article to be shipped;

c) a second cushioninng unit confronting said first cushioning unit and including a resiliently compressible portion disposed within the container and spanning the space between selected opposed interior surfaces of said exterior container and selected exterior surfaces of said article to be shipped;

d) said resiliently compressible confronting portion of each of said first and second cushioning units comprising a capsule containing a selected fluid at approximately atmospheric pressure whereby said capsule resiliently spans the space between said article to be shipped and the associated side and end walls of said container;

e) each said capsule being provided with a recess on the side thereof confronting the other capsule for receiving nestled therebetween an associated portion of said article to be shipped;

f) each said capsule being provided with a base member attached to the side thereof opposed to said recess and parallel to the associated end wall of said container, said base member having peripheral edge portions defined by peripheral edges lying juxtaposed to the interior surfaces of said container; and g) said base member is formed from a substantially rigid biodegradable material;

h) whereby said article is resiliently retained supported within said container and is spaced and resiliently cushioned from said opposed side and end walls by said confronting first and second cushioning units.

14. The packaging system according to claim 13, wherein said base member is adhesively secured to the associated surface of said capsule.

15. A packaging system wherein an article to be shipped is supported by resiliently compressible cushioning means, comprising:

a) an exterior container having opposed side and end walls defining the interior surface limits of said container within which said article to be shipped is disposed in spaced relation to said interior surfaces;

b) a first cushioning unit including a resiliently compressible portion disposed within the container and spanning the space between selected opposed interior surfaces of said exterior container and selected exterior surfaces of said article to be shipped;

c) a second cushioninng unit confronting said first cushioning unit and including a resiliently compressible portion disposed within the container and spanning the space between selected opposed interior surfaces of said exterior container and selected exterior surfaces of said article to be shipped;

d) said resiliently compressible confronting portion of each of said first and second cushioning units comprising a capsule containing a selected fluid at approximately atmospheric pressure whereby said capsule resiliently spans the space between said article to be shipped and the associated side and end walls of said container;

e) each said capsule being provided with a recess on the side thereof confronting the other capsule for receiving nestled therebetween an associated portion of said article to be shipped; and f) said recess in each said capsule is defined by an insert attached to said capsule and formed from biodegradable material;

g) whereby said article is resiliently retained supported within said container and is spaced and resiliently cushioned from said opposed side and end walls by said confronting first and second cushioning units.

16. The packaging system according to claim 15, wherein each said insert defining the recess in each said capsule is configured to correspond to the configuration of a confronting portion of said article to be shipped.

17. The packaging system according to claim 15, wherein said inserts mounted on said capsules are adhesively attached to the confronting surfaces of said capsules.

18. A packaging system wherein an article to be shipped is supported by independent resiliently compressible cushioning means, comprising:

a) a first sealed and non-inflatable cushioning unit distended by encapsulated fluid at approximately atmospheric pressure and including a resiliently compressible portion circumscribing selected exterior surfaces of said article to be shipped;

b) a second sealed and non-inflatable cushioning unit distended by encapsulated fluid at approximately atmospheric pressure and confronting said first sealed and non-inflatable cushioning unit and including a resiliently compressible portion circumscribing selected exterior surfaces of said article to be shipped; and c) means interconnecting said confronting first and second sealed and non-inflatable independent cushioning units to form a composite interconnected assembly including said cushioning units and the article supported therebetween.

19. The packaging system according to claim 18, wherein each of said independent resiliently compressible sealed and non-inflatable distended cushioning units includes at least two opposed spaced sides, and a relatively inflexible base member is secured to one of said two spaced sides, whereby when said cushioning units are applied to an article to be shipped the base member of each cushioning unit is parallel to the base member of the confronting cushioning unit and positioned on the opposite side of the article to be shipped.

20. The packaging system according to claim 18, wherein said means interconnecting said two confronting first and second sealed and non-inflatable independent cushioning units to form a composite interconnected assembly including said cushioning units and the article supported therebetween for shipment comprises at least one elongated member detachably joining said spaced cushioning units in a manner to prevent inadvertent separation thereof while being removable to enable disassembly of said composite assembly to provide access to said article.

21. The packaging system according to claim 18, wherein said means interconnecting said confronting first and second sealed and non-inflatable independent cushioning units for supporting said article therebetween comprises a container having at least two sides arranged to envelop said pair of confronting cushioning units.

22. The packaging system according to claim 19, wherein the side of each said sealed and non-inflatable cushioning unit opposite said base member is provided with a recess, and the associated portion of the article to be shipped projects into said recess.

23. The packaging system according to claim 22, wherein an insert of relatively inflexible material and having an inner periphery conforming at least partially to the outer periphery of the associated article is interposed in said recess between the article and the associated cushioning unit.

24. As an article of manufacture, an "air-pack" unit for use in confronting pairs to resiliently support and cushion against damage from impact shocks an article to be shipped disposed between said confronting pair of "air-pack" units, said "air-pack" unit comprising:

a) a resiliently compressible sealed and non-inflatable distended portion having spaced opposed sides at least one of which circumscribes selected exterior surfaces of a confronting article to be shipped;

b) a relatively inflexible base member sealingly attached to the side of said resiliently compressible sealed and non-inflatable distended portion and provided with peripheral edge portions; and c) a recess in the side of said resilient and compressible sealed and non-inflatable distended portion opposite said relatively inflexible base member and configured to circumscribingly envelop an associated confronting portion of an article disposed between said pair of confronting "air-pack" units;

d) said resilient and compressible sealed and non-inflatable distended portion comprising a capsule containing a selected fluid at approximately atmospheric pressure, whereby said capsule when deposited on an article to be shipped circumsribes selected exterior surfaces of the article to be shipped.

25. The "air-pack" unit according to claim 24, wherein said capsule is formed of synthetic resinous material.

26. The "air-pack" unit according to claim 24, wherein said capsule is formed from a sheet of flexible synthetic resinous material having peripheral edge portions sealingly secured to said peripheral edge portions of said relatively inflexible base member.

27. The "air-pack" unit according to claim 24, wherein said recess in said capsule is defined by an insert attached to said capsule and formed from biodegradable material.

28. The "air-pack" unit according to claim 27, wherein said insert defining said recess in said capsule is configured to correspond to the configuration of a confronting portion of the article to be shipped.

29. The "air-pack" unit according to claim 27, wherein said insert defining said recess is adhesively attached to the associated surface of said capsule.

30. The "air-pack" unit according to claim 24, wherein said capsule contains a comminuted resilient and compressible substance in addition to said fluid at approximately atmospheric pressure.

* * * * *